US008381690B2

(12) United States Patent
Jones

(10) Patent No.: US 8,381,690 B2
(45) Date of Patent: Feb. 26, 2013

(54) CONTROLLING COOLING FLOW IN A SOOTBLOWER BASED ON LANCE TUBE TEMPERATURE

(75) Inventor: Andrew K Jones, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 959 days.

(21) Appl. No.: 12/002,434

(22) Filed: Dec. 17, 2007

(65) Prior Publication Data

US 2009/0151656 A1 Jun. 18, 2009

(51) Int. Cl.
*F28G 1/16* (2006.01)

(52) U.S. Cl. ..... 122/390; 122/379; 122/396; 122/391; 122/392; 134/113; 134/22.1; 134/167 R; 134/168 R; 134/181; 134/34; 15/318

(58) Field of Classification Search ..... 122/390, 122/379, 396, 391, 392; 134/113, 22.1, 167 R, 134/168 R, 181, 34; 15/318
See application file for complete search history.

(56) References Cited

U.S. PATENT DOCUMENTS

| | | | | |
|---|---|---|---|---|
| 3,439,376 | A | | 4/1969 | Nelson et al. |
| 4,004,647 | A | | 1/1977 | Forst et al. |
| 4,037,469 | A | | 7/1977 | Nordstrom et al. |
| 4,085,438 | A | | 4/1978 | Butler |
| 4,339,998 | A | | 7/1982 | Finch |
| 4,351,277 | A | | 9/1982 | Ryan et al. |
| 4,359,800 | A | | 11/1982 | Ziels |
| 4,375,710 | A | | 3/1983 | Hammond |
| 4,380,843 | A | | 4/1983 | Sullivan et al. |
| 4,421,067 | A | | 12/1983 | Krowech |
| 4,422,882 | A | | 12/1983 | Nelson et al. |
| 4,430,963 | A | | 2/1984 | Finet |
| 4,454,840 | A | * | 6/1984 | Dziubakowski ..... 122/390 |
| 4,466,383 | A | * | 8/1984 | Klatt et al. ..... 122/379 |
| 4,475,482 | A | * | 10/1984 | Moss et al. ..... 122/379 |
| 4,488,516 | A | | 12/1984 | Bueters et al. |
| 4,492,187 | A | | 1/1985 | Hammond |
| 4,539,840 | A | * | 9/1985 | Klatt et al. ..... 73/113.01 |
| 4,565,324 | A | | 1/1986 | Rebula et al. |
| 4,567,622 | A | | 2/1986 | Ziels |

(Continued)

FOREIGN PATENT DOCUMENTS

| | | |
|---|---|---|
| CA | 2387369 | 10/2009 |
| EP | 1063021 A1 | 12/2000 |

(Continued)

*Primary Examiner* — Steven B McAllister
*Assistant Examiner* — Seth Greenia
(74) *Attorney, Agent, or Firm* — Matthew M. Eslami; Steven J. Rosen; Thomas W. Barnes, III

(57) ABSTRACT

A cleaning system and method for cleaning heat transfer surfaces in a boiler using a temperature measuring system for measuring and monitoring wall temperature of an annular wall of the tube of a lance of one or more sootblowers. Controlling a flow of steam or other fluid through the tube during the cooling portions of the strokes based on wall temperature measurements from the temperature measuring system. Infrared or thermocouple temperature measuring systems may be used. The steam or other fluid may be flowed at a default flowrate that may be substantially zero until the temperature measuring system indicates the wall temperature of the annular wall begins to exceed a predetermined temperature limit which may be the softening point of the annular wall. Then the steam or other fluid is flowed at a rate greater than the default flowrate.

23 Claims, 4 Drawing Sheets

U.S. PATENT DOCUMENTS 4,621,583 A 11/1986 Kaski
4,718,376 A * 1/1988 Leroueil et al. ..... 122/390
4,779,690 A 10/1988 Woodman
4,803,959 A 2/1989 Sherrick et al.
4,920,994 A * 5/1990 Nachbar ..... 134/1
4,986,391 A 1/1991 Salmon
5,048,636 A 9/1991 Roehrs
5,063,632 A 11/1991 Clark et al.
5,065,472 A 11/1991 Carpenter et al.
5,090,087 A 2/1992 Hipple et al.
5,113,802 A * 5/1992 Le Blanc ..... 122/379
5,181,482 A 1/1993 Labbe et al.
5,209,324 A 5/1993 Hogbacka
5,230,306 A 7/1993 Barringer et al.
5,237,718 A * 8/1993 Brown ..... 15/318.1
5,241,723 A 9/1993 Garrabrant
5,267,533 A 12/1993 Smith
5,271,356 A 12/1993 Kling et al.
5,286,063 A 2/1994 Huston
5,299,533 A 4/1994 Johnston et al.
5,320,073 A 6/1994 Silcott et al.
5,348,774 A 9/1994 Golecki et al.
5,353,996 A 10/1994 Gallacher et al.
5,365,890 A 11/1994 Johnston, Jr. et al.
5,375,771 A 12/1994 Jameel et al.
5,379,727 A 1/1995 Kling et al.
5,398,623 A 3/1995 Lautenschlager et al.
5,416,946 A 5/1995 Brown et al.
5,423,483 A 6/1995 Schwade
5,429,076 A 7/1995 Johnston, Jr. et al.
5,505,163 A 4/1996 Jameel
5,509,607 A 4/1996 Booher et al.
5,530,987 A 7/1996 Piccirillo et al.
5,549,079 A 8/1996 Johnston, Jr. et al.
5,549,305 A 8/1996 Freund
5,553,778 A 9/1996 Jameel et al.
5,605,117 A 2/1997 Moskal
5,606,924 A 3/1997 Martin et al.
5,619,771 A 4/1997 Minic
5,626,184 A 5/1997 Campbell et al.
5,663,489 A 9/1997 Thungstrom et al.
5,675,863 A 10/1997 Holden et al.
5,745,950 A 5/1998 Holden et al.
5,756,880 A 5/1998 Chen et al.
5,765,510 A 6/1998 Krowech et al.
5,769,035 A 6/1998 Fiedler
5,778,830 A 7/1998 Wall
5,778,831 A 7/1998 Jameel
5,836,268 A 11/1998 Wall
5,920,951 A 7/1999 Piccirillo et al.
6,065,528 A 5/2000 Fierle et al.
6,073,641 A 6/2000 Bude et al.
6,105,590 A 8/2000 Martin et al.
6,109,096 A 8/2000 Chen et al.
6,170,117 B1 1/2001 Batt
6,244,098 B1 6/2001 Chen et al.
6,323,442 B1 11/2001 Jones
6,325,025 B1 12/2001 Perrone
6,425,352 B2 7/2002 Perrone
6,575,122 B2 6/2003 Hipple
6,581,549 B2 6/2003 Stewart et al.
6,715,499 B2 * 4/2004 Bartels et al. ..... 134/22.12
6,736,089 B1 5/2004 Lefebvre et al.
6,764,030 B2 7/2004 Habib et al.
6,772,775 B2 8/2004 Ackerman et al.
6,782,902 B2 8/2004 Shover et al.
6,892,679 B2 5/2005 Jameel et al.
7,017,500 B2 3/2006 Jones
7,028,926 B2 4/2006 Habib et al.
7,055,209 B2 6/2006 Zalewski
7,267,134 B2 * 9/2007 Hochstein et al. ..... 134/166 R
7,341,067 B2 3/2008 Jones et al.
2004/0006841 A1 * 1/2004 Jameel et al. ..... 15/318.1
2004/0226758 A1 11/2004 Jones
2005/0199743 A1 * 9/2005 Hochstein et al. ..... 239/67
2006/0065291 A1 3/2006 Jones et al.
2010/0064470 A1 * 3/2010 Dahlen et al. ..... 15/316.1

FOREIGN PATENT DOCUMENTS

GB 2271440 A 4/1994
JP 62-278217 12/1987
JP 62278217 12/1987
RU 2143087 12/1999
WO WO 2008057039 A1 * 5/2008

* cited by examiner

CONTROLLING COOLING FLOW IN A SOOTBLOWER BASED ON LANCE TUBE TEMPERATURE

BACKGROUND OF THE INVENTION

1. Field of the Invention

This invention relates generally to boilers and sootblowers and, in particular, to methods and apparatus for removing ash deposits on heat exchangers of the boilers and for minimizing a flowrate of steam or other cleaning fluid through the sootblowers when not actively cleaning the ash deposit.

2. Description of Related Art

In the paper-making process, chemical pulping yields, as a by-product, black liquor which contains almost all of the inorganic cooking chemicals along with the lignin and other organic matter separated from the wood during pulping in a digester. The black liquor is burned in a boiler. The two main functions of the boiler are to recover the inorganic cooking chemicals used in the pulping process and to make use of the chemical energy in the organic portion of the black liquor to generate steam for a paper mill. As used herein, the term boiler includes a top supported boiler that, as described below, burns a fuel which fouls heat transfer surfaces.

A Kraft boiler includes superheaters in an upper furnace that extract heat by radiation and convection from the furnace gases. Saturated steam enters the superheater section and superheated steam exits at a controlled temperature. The superheaters are constructed of an array of platens that are constructed of tubes for conducting and transferring heat. Superheater heat transfer surfaces are continually being fouled by ash that is being carried out of the furnace chamber. The amount of black liquor that can be burned in a Kraft boiler is often limited by the rate and extent of fouling on the surfaces of the superheater. The fouling, including ash deposited on the superheater surfaces, reduces the heat absorbed from the liquor combustion, resulting in reduced exit steam temperatures from the superheaters and high gas temperatures entering the boiler bank.

Boiler shutdown for cleaning is required when either the exit steam temperature is too low for use in downstream equipment or the temperature entering the boiler bank exceeds the melting temperature of the deposits, resulting in gas side pluggage of the boiler bank. In addition, eventually fouling causes plugging and, in order to remove the plugging, the burning process in the boiler has to be stopped. Kraft boilers are particularly prone to the problem of superheater fouling. Three conventional methods of removing ash deposits from the superheaters in Kraft boilers include:
1) sootblowing, 2) chill-and-blow, and 3) waterwashing. This application addresses only the first of these methods, sootblowing.

Sootblowing is a process that includes blowing deposited ashes off the superheater (or other heat transfer surface that is plagued with ash deposits, with a blast of steam from nozzles of a lance of a sootblower. A sootblower lance has a lance tube for conducting the steam to a nozzle at a distal end of the lance. Sootblowing is performed essentially continuously during normal boiler operation, with different sootblowers turned on at different times. Sootblowing is usually carried out using steam. The steam consumption of an individual sootblower is typically 4-5 kg/s; as many as 4 sootblowers are used simultaneously. Typical sootblower usage is about 3-7% of the steam production of the entire boiler. The sootblowing procedure thus consumes a large amount of thermal energy produced by the boiler.

The sootblowing process may be part of a procedure known as sequence sootblowing, wherein sootblowers operate at determined intervals in an order determined by a certain predetermined list. The sootblowing procedure runs at its own pace according to the list, irrespective of whether sootblowing is needed or not. Often, this leads to plugging that cannot necessarily be prevented even if the sootblowing procedure consumes a high amount of steam. Each sootblowing operation reduces a portion of the nearby ash deposit but the ash deposit nevertheless continues to build up over time. As the deposit grows, sootblowing becomes gradually less effective and results in impairment of the heat transfer. When the ash deposit reaches a certain threshold where boiler efficiency is significantly reduced and sootblowing is insufficiently effective, deposits may need to be removed by another cleaning process.

A steam sootblower, typically, includes a lance having an elongated tube with a nozzle at a distal end of the tube and the nozzle has one or more radial openings. The tube is coupled to a source of pressurized steam. The sootblowers are further structured to be inserted and extracted into the furnace or moved between a first position located outside of the furnace, to a second location within the furnace. As the sootblowers move between the first and second positions, the sootblower rotates and adjacent to the heat transfer surfaces. Sootblowers are arranged to move generally perpendicular to the heat transfer surfaces.

Some of the platens having heat transfer surfaces have passages therethrough to allow movement perpendicular to the heat transfer surfaces. The movement into the furnace, which is typically the movement between the first and second positions, may be identified as a "first stroke" or insertion, and the movement out of the furnace, which is typically the movement between the second position and the first position, may be identified as the "second stroke" or extraction. Generally, sootblowing methods use the full motion of the sootblower between the first position and the second position; however, a partial motion may also be considered a first or second stroke.

As the sootblower moves adjacent to the heat transfer surfaces, the steam is expelled through the openings in the nozzle. The steam contacts the ash deposits on the heat transfer surfaces and dislodges a quantity of ash, some ash, however, remains. As used herein, the term "removed ash" shall refer to the ash deposit that is removed by the sootblowing procedure and "residual ash" shall refer to the ash that remains on a heat transfer surface after the sootblowing procedure. The steam is usually applied during both the first and second strokes.

Rather than simply running the sootblowers on a schedule, it may be desirable to actuate the sootblowers when the ash buildup reaches a predetermined level. One method of determining the amount of buildup of ash on the heat transfer surfaces within the furnace is to measure the weight of the heat transfer surfaces and associated superheater components. One method of determining the weight of the deposits is disclosed in U.S. Pat. No. 6,323,442 and another method is disclosed in U.S. patent application Ser. No. 10/950,707, filed Sep. 27, 2004, both of which are incorporated herein by reference. It is further desirable to conserve energy by having the sootblowers use a minimum amount of steam when cleaning the heat transfer surfaces.

BRIEF SUMMARY OF THE INVENTION

A cleaning system for cleaning heat transfer surfaces of one or more heat exchangers in a boiler includes one or more sootblowers, each of which includes a lance with an elongated hollow tube and two nozzles at a distal end of the tube. A temperature measuring system is used for measuring and monitoring wall temperature of an annular wall of the tube during operation of the one or more sootblowers.

An exemplary embodiment of the cleaning system includes that each of the sootblowers is operable for moving the lance in and out of the boiler in insertion and extraction strokes and a control system is used for controlling a flow of steam or other cleaning fluid through the tube and nozzle during cleaning portions and cooling portions of the strokes. The control means is further operable for controlling the flow of steam during the cooling portions of the strokes based on wall temperature measurements from the temperature measuring system. The control means is further operable for controlling the flow of steam during the cooling portions of the strokes to prevent the wall temperature measurements from exceeding a predetermined temperature limit which may be a softening point or slightly less than the softening point of the tube.

The temperature measuring system may be an infrared temperature measuring system for measuring the wall temperature of the annular wall outside the boiler. The temperature measuring system may be a thermocouple temperature measuring system having thermocouples attached to the annular wall for measuring the wall temperature of the annular wall inside the boiler. The thermocouples may be partially disposed from an inside surface of the annular wall in holes through and along a length of the annular wall.

The method of operating the cleaning system may include flowing the steam or the other hot cleaning fluid through the tube and nozzle during the cooling portions of the strokes at a flowrate equal to a default value unless the wall temperature exceeds or is about to exceed the predetermined temperature limit based on temperature measurements from the temperature measuring system and, then, increasing the flowrate above the default value. The default value may be substantially zero.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
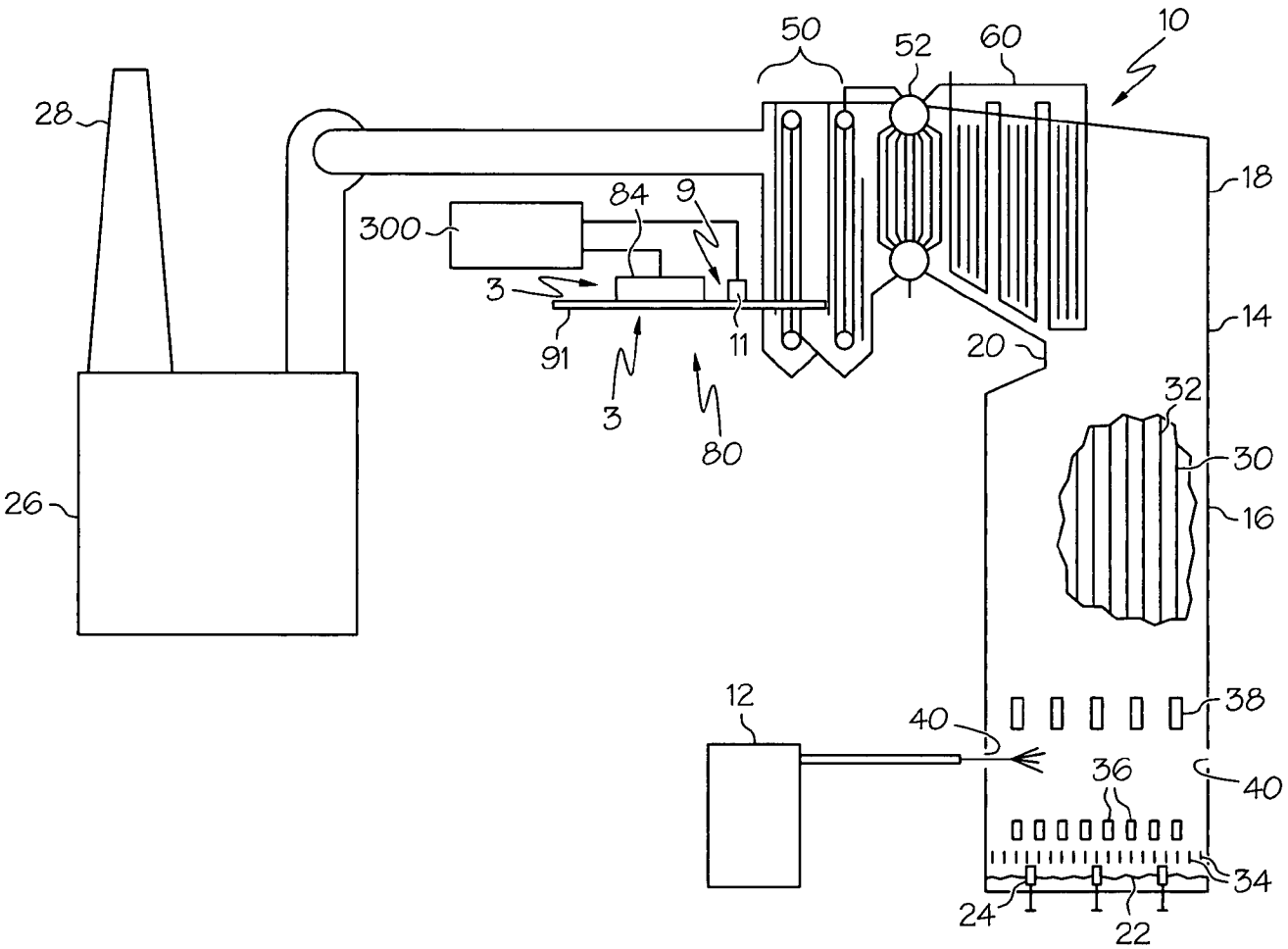
FIG. 1 is a diagrammatical illustration of a typical Kraft black liquor boiler system having several sootblowers and a temperature measuring system for measuring and monitoring lance tube temperature and basing a cleaning fluid flowrate through the sootblowers on the temperature.
Figure 5:
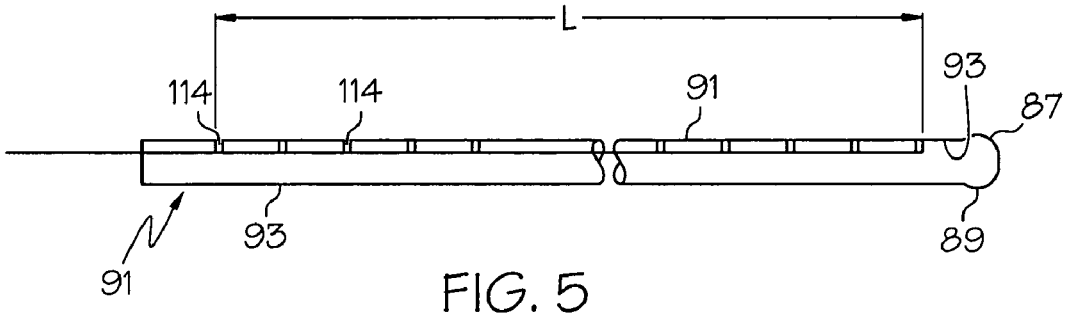
FIG. 5 is a diagrammatical illustration of a thermocouple temperature measuring system for measuring temperature of the tubes of the sootblower lances illustrated in FIGS. 1 and 2.
Figure 6:
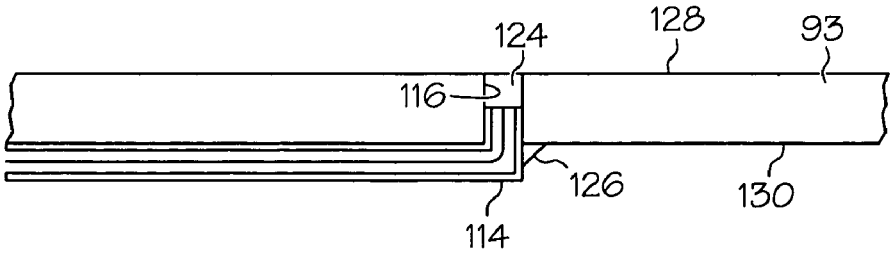
FIG. 6 is a diagrammatical illustration of a thermocouple mounted in the tube of the lance of the thermocouple temperature measuring system illustrated in FIG. 4.

Diagrammatically illustrated in FIG. 1 is an exemplary embodiment of a Kraft black liquor boiler system 10 having a sootblower system 3 with one or more sootblowers 84. A Kraft black liquor boiler system 10 having a plurality of sootblowers 84 is disclosed and described in U.S. patent application Ser. No. 10/950,707, filed Sep. 27, 2004, entitled "Method of Determining Individual Sootblower Effectiveness" which is incorporated herein by reference. A control system 300 which operates the sootblower 84 in part based on a measured temperature of an annular wall 93 of a tube 86 of a lance 91 of the sootblower. The sootblower 84 typically rotates the lance 91 during operation. The annular wall's 93 temperature is measured and/or monitored with a temperature measuring system 9 illustrated in FIG. 1 as an infrared temperature measuring system 11 as illustrated in more detail in FIGS. 3 and 4. Other types of temperature measuring systems may be used such as a thermocouple temperature measuring system 13 as illustrated in FIGS. 5 and 6.

Black liquor is a by-product of chemical pulping in the paper-making process and which is burned in the boiler system 10. The black liquor is concentrated to firing conditions in an evaporator 12 and then burned in a boiler 14. The black liquor is burned in a furnace 16 of the boiler 14. A bullnose 20 is disposed between a convective heat transfer section 18 in the boiler 14 and the furnace 16. Combustion converts the black liquor's organic material into gaseous products in a series of processes involving drying, devolatilizing (pyrolyzing, molecular cracking), and char burning/gasification. Some of the liquid organics are burned to a solid carbon particulate called char. Burning of the char occurs largely on a char bed 22 which covers the floor of the furnace 16, though some char burns in flight. As carbon in the char is gasified or burned, the inorganic compounds in the char are released and form a molten salt mixture called smelt, which flows to the bottom of the char bed 22, and is continuously tapped from the furnace 16 through smelt spouts 24. Exhaust gases are filtered through an electrostatic precipitator 26, and exit through a stack 28.

Vertical walls 30 of the furnace 16 are lined with vertically aligned wall tubes 32, through which water is evaporated from the heat of the furnace 16. The furnace 16 has primary level air ports 34, secondary level air ports 36, and tertiary level air ports 38 for introducing air for combustion at three different height levels. Black liquor is sprayed into the furnace 16 out of black liquor guns 40. The heat transfer section 18 contains three sets of tube banks (heat traps) which successively, in stages, heat the feedwater to superheated steam. The tube banks include an economizer 50, in which the feedwater is heated to just below its boiling point; a boiler bank 52, or "steam generating bank" in which, along with the wall tubes 32, the water is evaporated to steam; and a superheater system 60, which increases the steam temperature from saturation to the final superheat temperature.

Figure 2:
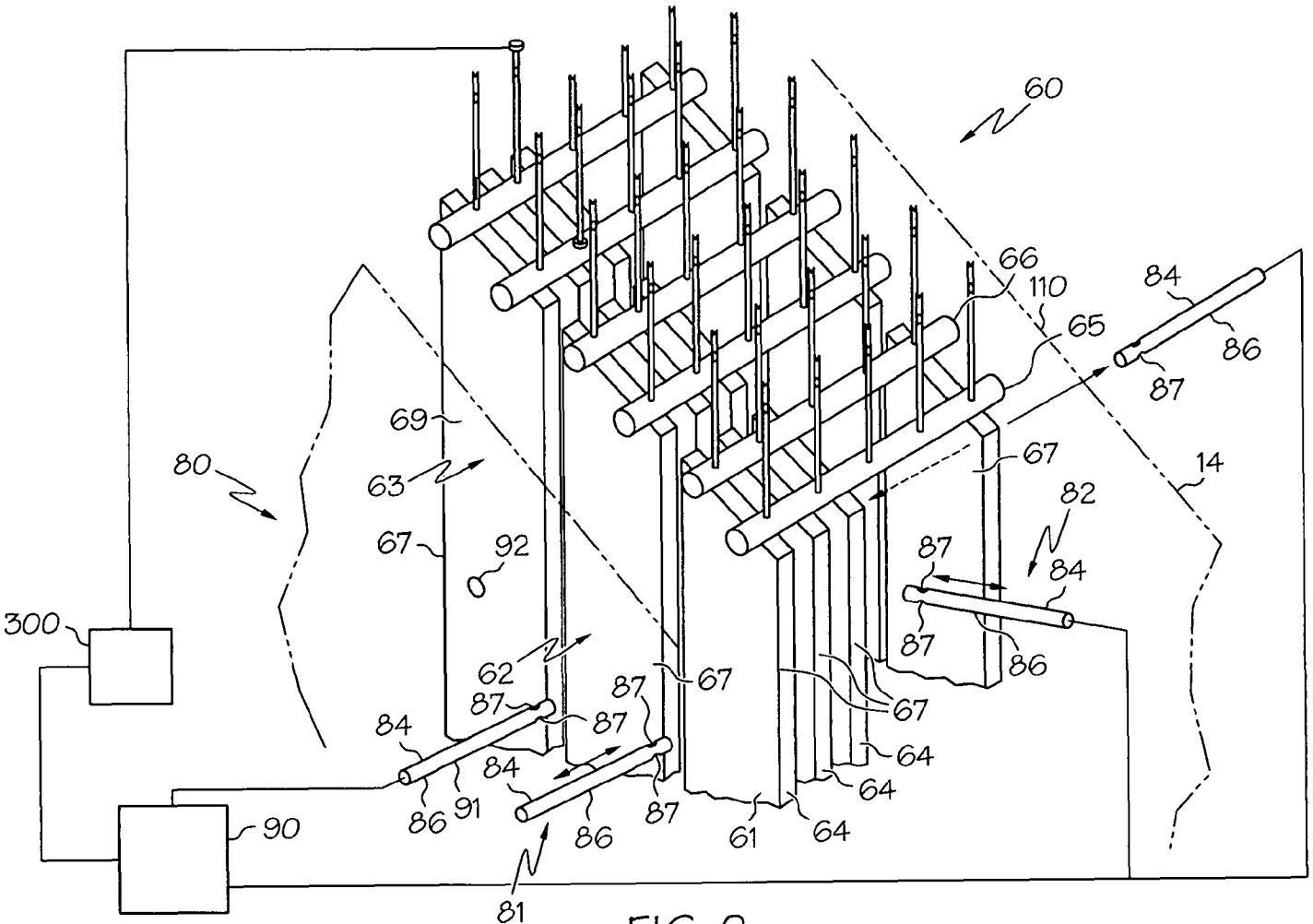
FIG. 2 is a diagrammatical illustration of the sootblowers in a superheater in the boiler system illustrated in FIG. 1.

Referring to FIG. 2, the superheater system 60 illustrated herein has first, second, and third superheaters 61, 62, and 63 for a total of three superheaters, however, more or less superheaters may be incorporated as needed. The construction of the three superheaters is the same. Each superheater is an assembly having at least one but typically more, such as 20-50, heat exchangers 64. Steam enters the heat exchangers 64 through a manifold tube called an inlet header 65. Steam is superheated within the heat exchangers 64 and exits the heat exchangers as superheated steam through another manifold tube called an outlet header 66. The heat exchangers 64 are suspended from the headers 65, 66 which are themselves suspended from the overhead beams by hanger rods not illustrated herein.

Platens 67 of the heat exchanger 64 have outer surfaces referred to herein as a heat transfer surfaces 69 which are exposed to the hot interior of the furnace 16. Thus, virtually all parts of the heat transfer surfaces are likely to be coated with ash during normal operation of the furnace 16. A substantial portion of the heat transfer surfaces are cleaned, that is, have a portion of ash removed, by a cleaning system 80. The cleaning system 80 includes at least one, and preferably a plurality of steam sootblowers 84, which are known in the art. The cleaning system 80 illustrated herein includes steam sootblowers 84; however the cleaning system 80 may also be used with sootblowers using other cleaning fluids. The sootblowers 84 are arranged to clean the heat exchangers and, more specifically, the heat transfer surfaces. Sootblowers 84 include elongated hollow tubes 86 having two nozzles 87 at distal ends 89 of the tubes 86. The two nozzles 87 spaced about 180 degrees apart.

The tubes 86 are in fluid communication with a steam source 90. In one embodiment of the cleaning system 80, the steam is supplied at a pressure of between about 200 to 400 psi. The steam is expelled through the nozzles 87 and onto the heat transfer surfaces. The sootblowers 84 are structured to move the nozzles 87 at the end of the tubes 86 inwardly between a first position, typically outside the furnace 16, and a second position, adjacent to the heat exchangers 64. The inward motion, between the first and second positions, is called an insertion stroke and an outwardly motion, between the second position and the first position, is called an extraction stroke.

A first set 81 of the sootblowers 84 are operable to move the nozzles 87 at the end of the tubes 86 generally perpendicular to and in between the heat exchangers 64. A second set 82 of the sootblowers 84 are operable to move the nozzles 87 at the end of the tubes 86 generally parallel to and in between the heat exchangers 64. A plurality of tubular openings 92 through the heat exchangers 64 are provided for allowing the tubes 86 of the first set 81 of the sootblowers 84 to move generally perpendicular through the heat exchangers 64. The heat exchangers 64 are sealed and the tubes 86 may pass freely through the tubular openings 92.

Steam is expelled from the nozzles 87 as the nozzles 87 move between the first and second positions. As the steam contacts the ash coated on the heat transfer surfaces, a portion of the ash is removed. Over time, the buildup of residual ash may become too resilient to be removed by the sootblowers 84 and an alternate ash cleaning method may be used. The sootblowers 84 described above utilize steam, it is noted however, that the invention is not so limited and the sootblowers may also use other cleaning fluids that for example may include air and water-steam mixtures.

Operation of the cleaning system 80 is controlled by a control system 300 which controls the cleaning system 80 based on the weight of the ash deposits on one or more of the heat exchangers 64. The control system 300 also controls the amount of steam supplied or the steam's flowrate to the tubes 86 during cleaning portions of the insertion and extraction strokes and during cooling portions of the insertion and extraction strokes. The control system 300 is programmed to activate the insertion and extraction of the lances 91 of the sootblowers 84, that is, movement between the lance's 91 first and second position, speed of travel, and the application and/or quantity of steam.

Cleaning steam is typically applied on the insertion stroke of the lances 91 but may also be applied on the extraction or both strokes. The steam is applied at a cleaning rate to remove the ash and at a cooling rate to prevent the lance 91 from getting too hot. In conventional Kraft boilers, steam has been applied at a cleaning rate or cleaning flow of between 15,000-20,000 lbs/hr and at a cooling rate or cooling flow of between 5,000-6,000 lbs/hr to ensure that the sootblower lance is operating well below the temperature limit of the material. The steam may be supplied anywhere from substantially zero to one hundred percent of the maximum quantity that the cleaning system is programmed to deliver. The control system 300 using the measured temperature of the annular wall 93, illustrated in FIGS. 3 and 6 of the tube 86 of the lance 91 from the temperature measuring system 9 to control and minimize the cooling flow. For a boiler using cleaning flow of between 15,000-20,000 lbs/hr, a cooling flow of between 0 and 2,000 lbs/hr may be achieved using the temperature measuring system 9 to control and minimize the cooling flow.

The use of steam to clean heat exchangers 64 is expensive. Therefore, it is desirable to use only the amount of steam needed to remove the ash. Substantially less steam is used during the cooling portions than the cleaning portions of the strokes. Cleaning or cooling amounts of steam may be used during either the insertion or extraction strokes. In one embodiment of the sootblowing method one-way cleaning is used to reduce the sootblowing steam used. One-way cleaning uses full cleaning flow during the insertion stroke into the boiler and only cooling flow during the extraction stroke or on the way out of the boiler. During the cooling portions of the stroke, steam is used only to keep the lances 91 of the sootblowers 84 cool. The temperature measuring system 9 is used to measure or monitor the temperature of the lance's tube 86 and minimize the amount of steam used during the cooling portions of the stokes.

The cleaning system 80 uses the temperature measuring system 9 to continuously measure or monitor the temperature of a sootblower lance tube 86 while it is operating in the boiler 14. The control system varies the cooling flow within the lance 91 (using a variable flow control valve not shown) to prevent the wall temperature of the annular wall 93 of the tube 86 of the lance 91 from exceeding a predetermined temperature limit. In one exemplary method of cleaning system 80, the amount of steam supplied or the steam's flowrate to the tubes 86 during the cooling portions of the strokes is set to a default value which may be substantially zero and is increased if the control system 300 determines that the wall temperature exceeds or is about to exceed the predetermined temperature limit based on temperature measurements from the temperature measuring system 9.

In one exemplary method of using the temperature measuring system 9, steam is supplied at a flowrate that is as low as possible without the temperature of the tube 86 rising above its softening point or temperature. Thus, the maximum allowable temperature of the tube 86 is its softening temperature. The flowrate of steam is minimized without allowing the lance's tube temperature to exceed its softening point based on direct temperature measurements of the tube 86.

Figure 3:
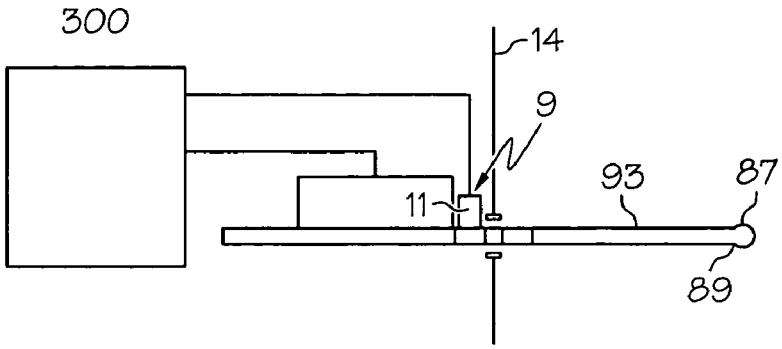
FIG. 3 is a diagrammatical illustration of a infrared temperature measuring system for measuring temperature of the tubes of the sootblower lances illustrated in FIGS. 1 and 2.
Figure 4:
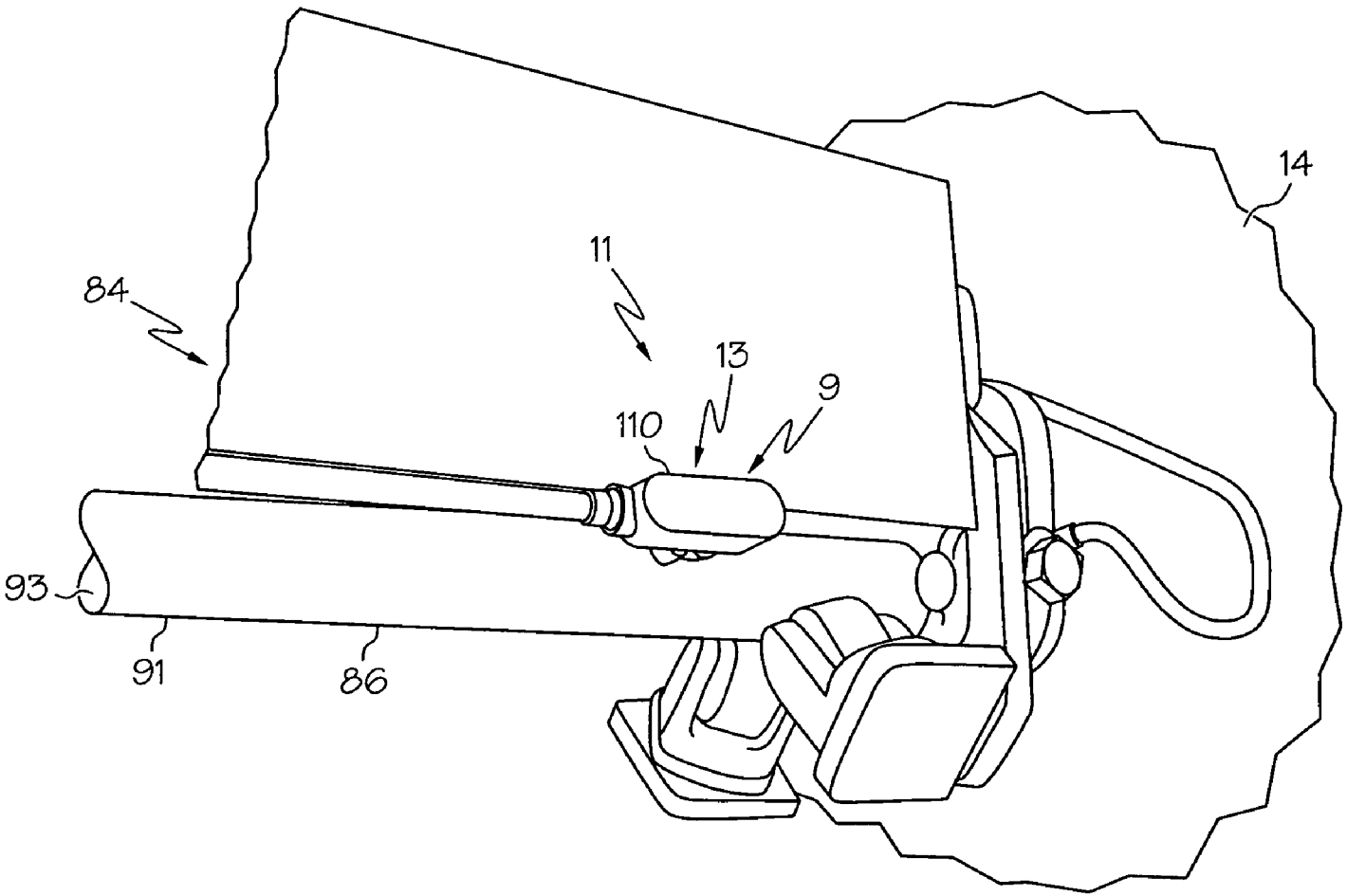
FIG. 4 is an illustration of an infrared sensor of the infrared temperature measuring system for measuring temperature of the tubes of the sootblower lances illustrated in FIG. 3.

Two types of temperature measuring systems 9 are illustrated herein. An infrared temperature measuring system 11 is illustrated in FIGS. 1 and 3. In the embodiment of the infrared temperature measuring system 11 illustrated herein an infrared sensor 110 is located outside and adjacent to the boiler 14 and, is thus, operable for measuring the wall temperature of the annular wall 93 of the lance tube 86 as it is extracted and inserted into the boiler 14. Though the infrared sensor 110 is located outside the boiler 14, it gives an accurate reading of the wall temperature because of the large thermal mass of the annular wall 93 and the rapid extraction of the lance from the furnace. These two factors result in the temperature being measured at this location to be essentially the same temperature of the lance immediately before it exits the boiler 14.

Other types of temperature measuring systems may be used. One such system is a thermocouple temperature measuring system 13 as illustrated in FIGS. 5 and 6. One or more thermocouples 114 are attached to the annular wall 93 of the lance tube 86 to measure the wall temperature of the annular wall 93 inside the boiler 14. As illustrated herein, a number of the thermocouples 114 are partially disposed from an inside surface 130 of the annular wall 93 in tight fitting holes 116 through and along a length L of the annular wall 93. Plugs 124 are disposed in the holes 116 between an outer surface 128 of the annular wall 93 and the thermocouples 114 disposed in the holes 116. The thermocouples 114 are welded, indicated by weld 126 to an inside surface 130 of the annular wall 93. The thermocouples 114 are connected to a transmitter (not shown) mounted on an outside of the lance 91 on an outside portion of the lance 91 that does not enter the boiler 14. The transmitter transmits temperature readings of the thermocouples to the control system 300 which operates the sootblower 84.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

The invention claimed is:

1. A system for minimizing an amount of cooling flow in a sootblower based on lance temperature, the system comprising:

one or more sootblowers, each of the sootblowers having a lance with an elongated hollow tube and at least one nozzle at a distal end of the tube, each of the sootblowers being operable for moving the lance in and out of the boiler in insertion and extraction strokes, a temperature measuring system for measuring and monitoring wall temperature of an annular wall of the tube during operation of the one or more sootblowers, a programmable control system for controlling a flow of steam through the tube and nozzle during cleaning portion and cooling portion of the strokes wherein in the cooling portion of the stroke a lower flow rate of steam is used as compared to the cleaning portion of the stroke, and the programmable control system operable for minimizing the flow of steam during the cooling portions of the strokes based on wall temperature measurements from the temperature measuring system and preventing the wall temperature measurement from exceeding a predetermined temperature limit.

2. The system of claim 1 wherein the predetermined temperature limit is a softening point or slightly less than the softening point of the tube.

3. The system of claim 1 wherein the temperature measuring system is an infrared temperature measuring system for measuring the wall temperature of the annular wall outside the boiler and the control system is operable to provide the cooling portion of the strokes only during the extraction stroke.

4. The system of claim 3 wherein the infrared temperature measuring system is operable for measuring the wall temperature of the annular wall outside and adjacent to the boiler.

5. The system of claim 1 wherein the temperature measuring system is a thermocouple temperature measuring system for measuring the wall temperature of the annular wall inside the boiler.

6. The system of claim 5 wherein the control system is operable for controlling the flow of steam during the cooling portion of the strokes to maintain the wall temperature measurements below a predetermined temperature limit.

7. The system of claim 6 wherein the predetermined temperature limit is a softening point or slightly less than the softening point of the tube.

8. The system of claim 7 wherein the thermocouples are attached to the annular wall.

9. The system of claim 8 wherein the thermocouples are partially disposed from an inside surface of the annular wall in holes through and along a length of the annular wall.

10. A method of operating a system for minimizing an amount of cooling flow in a sootblower based on lance temperature, the method comprising the steps of:

using one or more sootblowers to clean heat transfer surfaces of one or more heat exchangers in a boiler, flowing cleaning fluid through an elongated hollow tube of a lance of each of the sootblowers, discharging the steam or the other hot cleaning fluid from at least one nozzle at a distal end of the tube against the heat transfer surfaces, measuring and monitoring wall temperature of an annular wall of the tube during operation of the one or more sootblowers using a temperature measuring system, moving the lance in and out of the boiler in insertion and extraction strokes, using a programmable control system for controlling the flowing of the steam or the other hot cleaning fluid through the tube and nozzle during cleaning portion and cooling portion of the strokes wherein in the cooling portion of the stroke a lower flow rate of steam is used as compared to the cleaning portion of the stroke, and using the programmable control system operable for minimizing the flowing of the steam or the other hot cleaning fluid through the tube and nozzle during the cooling portions of the strokes based on wall temperature measurements from the measuring and the monitoring of the wall temperature of an annular wall of the tube and preventing the wall temperature measurement from exceeding a predetermined temperature limit.

11. The method of claim 10 wherein the predetermined temperature limit is a softening point or slightly less than the softening point of the tube.

12. The method of claim 10 further comprising using an infrared temperature measuring system for the measuring and the monitoring of the wall temperature of the annular wall outside the boiler and wherein the cooling portion of the strokes occur only during the extraction stroke.

13. The method of claim 12 wherein using the infrared temperature measuring system for measuring the wall temperature of the annular wall outside and adjacent to the boiler.

14. The method of claim 13 wherein controlling the flowing of the steam or the other hot cleaning fluid through the tube and nozzle during the cooling portion of the strokes to maintain the wall temperature measurements below a predetermined temperature limit.

15. The method of claim 14 wherein the predetermined temperature limit is a softening point or slightly less than the softening point of the tube.

16. The method of claim 10 further comprising using a thermocouple temperature measuring system for the measuring and the monitoring of the wall temperature of the annular wall.

17. The method of claim 16 wherein controlling the flowing of the steam or the other hot cleaning fluid through the tube and nozzle during the cooling portion of the stroke to maintain the wall temperature measurements below a predetermined temperature limit.

18. The method of claim 17 wherein the predetermined temperature limit is a softening point or slightly less than the softening point of the tube.

19. The method of claim 18 wherein the measuring of the wall temperature of the annular wall including using thermocouples are attached to the annular wall.

20. The method of claim 18 wherein the measuring of the wall temperature of the annular wall including using thermocouples are partially disposed from an inside surface of the annular wall in holes through and along a length of the annular wall.

21. The method of claim 10 wherein flowing the steam or the other hot cleaning fluid through the tube and nozzle during the cooling portion of the strokes at a flow rate equal to a default value unless the wall temperature exceeds or is about to exceed the predetermined temperature limit based on temperature measurements from the temperature measuring system 9 and then increasing the flow rate above the default value.

22. The method of claim 21 wherein the default value is substantially zero.

23. The method of claim 22 wherein the predetermined temperature limit is a softening point or slightly less than the softening point of the tube.

* * * * *